US006461216B1

(12) United States Patent
Applewhite et al.

(10) Patent No.: US 6,461,216 B1
(45) Date of Patent: Oct. 8, 2002

(54) TOY DEVICE

(76) Inventors: John T. Applewhite, 1203 Wilkes Way, Marietta, GA (US) 30064; Steve Chininis, 5704 Wilmer Dr., Norcross, GA (US) 30092; Jose Longoria, 8325 Southwest 108$^{th}$ St., Miami, FL (US) 33156

( * ) Notice: Subject to any disclaimer, the term of this patent is extended or adjusted under 35 U.S.C. 154(b) by 21 days.

(21) Appl. No.: 09/652,496

(22) Filed: Aug. 31, 2000

(51) Int. Cl.$^{7}$ ..... A63H 33/22

(52) U.S. Cl. ..... 446/219; 446/396; 446/325; 446/227; 359/617

(58) Field of Search ..... 359/616, 617, 359/850; 446/485, 396, 325, 324, 219, 227, 489, 491; 40/582, 583

(56) References Cited

U.S. PATENT DOCUMENTS

| | | | | | |
|---|---|---|---|---|---|
| 1,895,173 | A | * | 1/1933 | Sandford | 40/583 |
| 2,452,363 | A | | 10/1948 | Flotron | 88/15 |
| 2,942,379 | A | * | 6/1960 | Oman et al. | 446/396 |
| 3,237,512 | A | | 3/1966 | Beverett | 88/15 |
| 3,304,651 | A | * | 2/1967 | Deyerl | 473/570 |
| 3,383,150 | A | | 5/1968 | Powers | 350/5 |
| 3,756,685 | A | | 9/1973 | Forsee | 350/5 |
| 3,930,711 | A | | 1/1976 | Powell | 350/4 |
| 4,205,893 | A | | 6/1980 | Taylor | 350/4.2 |
| D271,032 | S | | 10/1983 | Bennett | D21/60 |
| 4,645,471 | A | * | 2/1987 | Herring et al. | 473/569 |
| 5,924,942 | A | * | 7/1999 | Gentile | 446/485 |
| 6,165,038 | A | * | 12/2000 | Muller | 446/219 |

* cited by examiner

*Primary Examiner*—Jacob K. Ackun
*Assistant Examiner*—Urszula M Cegielnik
(74) *Attorney, Agent, or Firm*—Baker, Donelson, Bearman & Caldwell

(57) ABSTRACT

A toy device (10) is provided having a housing (11) having a top viewing side (12) and a bottom side (13). The housing (11) has a cavity (15) therein having an annular array of light reflecting surfaces (16). Mounted concentrically within the annular array of light reflecting surfaces is a rotatable sphere (18) having a decorative pattern thereon. The housing cavity (15) has an opening (19) extending from the bottom side (13) sized and shaped to allow a portion of the sphere (18) to extend past the housing bottom side (13).

18 Claims, 2 Drawing Sheets

FIG. 1
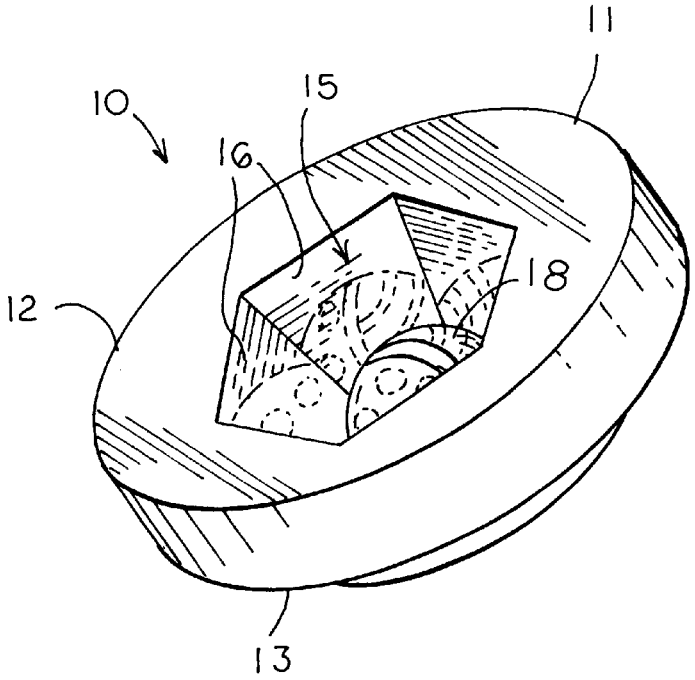
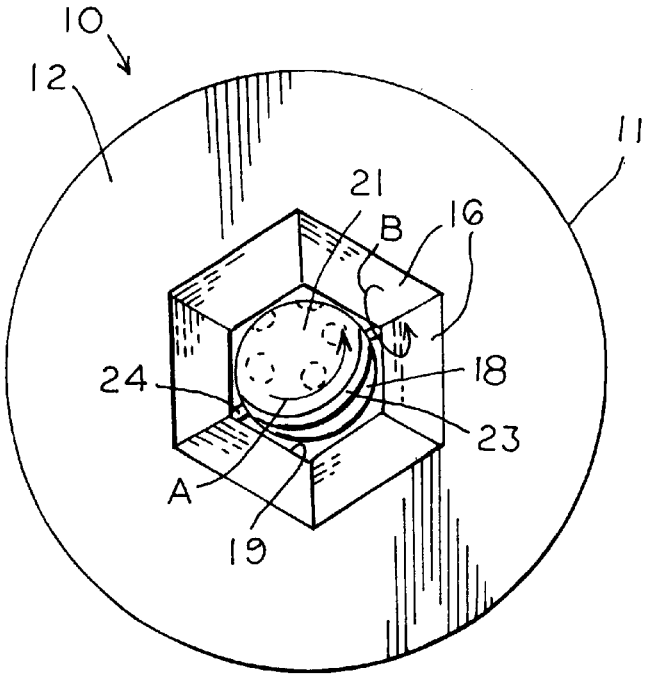
FIG. 2

TOY DEVICE

TECHNICAL FIELD

This invention relates to toy devices, and specifically to a toy devices which produce an effect similar to that of a kaleidoscope.

BACKGROUND OF THE INVENTION

Kaleidoscopes have existed for many years. These devices typically contain loose bits of colored glass or plastic positioned between two flat transparent plates. Two plane mirrors are positioned so that changes in the configuration of the glass particles are reflected in endless procession of variegated designs. The colored glass bits and mirrors are positioned within an elongated tube wherein the glass bits are positioned at one end of the tube and a viewing eye piece or opening is positioned at an opposite end of the tube.

In use, these kaleidoscopes are manually manipulated so that the end containing the glass bits is directed towards a light source and the tube rotated to cause the repositioning of the glass bits, and therefore a different appearance of the reflected pattern viewed by an operator. This type of manual manipulation however can not be accomplished by an infant, as an infant typically can not physically handle the tube, can not co-ordinate the direction of the tube towards a light source, and can not co-ordinate the rotation of the tube to cause a change in the viewable pattern through the movement of the glass bits.

Kaleidoscopes have also been devised with transparent spheres rather than pieces of glass bits between transparent plates, as shown in U.S. Pat. Nos. 2,452,363, 4,120,116 and 3,383,150. These kaleidoscopes however must still be manually manipulated to rotate the sphere, to position the eye piece adjacent one's eye for viewing, and to point the kaleidoscope at a light source. Hence, these kaleidoscopes also may not be utilized by an infant.

Accordingly, it is seen that a need remains for a visually stimulating toy device which may be manipulated by an infant having minimal motor skill co-ordinations. It is to the provision of such therefore that the present invention is primarily directed.

SUMMARY OF THE INVENTION

In a preferred form of the invention a toy device comprises a housing having an upper side and a lower side opposite the upper side, a rotatable member mounted to the housing so as to project outwardly from the housing lower side, and an annular array of reflective surfaces positioned upon the housing upper side and concentrically about the rotatable member. The housing has a size and shape so that the device may be stably positioned upon a substantially horizontal, planar underlying surface with the rotatable member and a portion of the housing contacting the underlying surface with the annular array of reflective surfaces facing generally upwardly. With this construction, a child may move the device across the underlying surface to cause the rotation of the rotatable member, with the image of the rotatable member being reflected upwardly by the annular array of reflective surfaces.

BRIEF DESCRIPTION OF THE DRAWING

FIG. 1 is a perspective view of a toy device embodying principles of the invention is a preferred form.

FIG. 2 is a top view of the toy device of FIG. 1.

DETAILED DESCRIPTION

Figure 3:
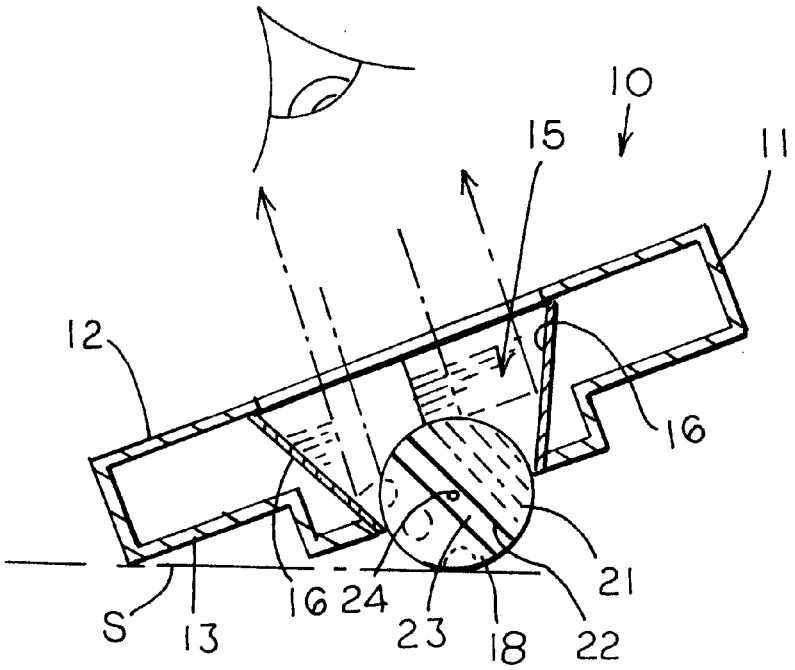
FIG. 3 is an exploded view of a portion of the toy device of FIG. 1.

With reference next to the drawings, there is shown a toy device 10 incorporating principles of the invention in a preferred form. The toy device 10 has a housing 11 having a front or top viewing side 12 and a rear or bottom side 13. The housing 11 has a cavity 15 therein having an annular array of light reflecting surfaces 16. Mounted concentrically within the annular array of light reflecting surfaces 16 is a rotatable sphere 18 having a decorative pattern thereon. The housing cavity 15 has an opening 19 extending from the housing bottom side 13 which is sized and shaped to allow a portion of the sphere 18 to extend beyond the housing bottom side 13.

The rotatable sphere 18 includes an orb 21 having an annular groove 22 therein and a ring 23 sized and shaped to be received within the annular groove 22 to allow rotational movement of the orb 21 relative to the ring 23 in a first direction indicated by arrow a. A pair of mutually aligned pivot pins 24 is coupled to the ring 23 to allow rotational movement of the ring, and thereby the orb 21, relative to the housing 11 in a second direction indicated by arrow b. The second direction of rotation b is generally normal to the first direction of rotation a.

In use, the housing 11 of the device 10 may be grasped by an infant with one hand and the sphere 18 rotated by mere contact with the other hand of the infant on either the top facing surface of the sphere 18 positioned towards the infant or on the rear facing surface of the sphere 18 projecting past the bottom side 13 of the housing. The rotation of the sphere 18 causes different areas of the pattern upon the sphere to be reflected by the annular array of reflective surfaces 16. The reflection of these changing patterns gives the toy device the effect of a kaleidoscope.

It should be understood that with the present device the light emanates from the front of the device and is reflected back towards an infant viewing the front of the device, as shown in FIG. 3. As such, an infant is not required to direct the device at a light source in order to view the multiple reflected images. This elimination of having to align the device with a light source enables one of limited motor skills to operate the device, as opposed to kaleidoscopes of the prior art.

The device is also adapted to be rested upon a generally, flat, planar surface S with at least the rear facing portion of the sphere 18 and a portion of the housing 11 contacting the underlying surface S, as shown in FIG. 3. With the device resting upon the surface the front side of the device is facing upwardly so that it may be viewed easily by an infant. Furthermore, should the infant move the device upon the underlying surface the contact between the sphere 18 and the underlying surface causes the sphere to rotate. As such, an infant with minimal motor skills may actuate the movement of the sphere, and thus a change in the reflective pattern, by simply bumping or slightly moving the device upon a surface, such as a floor.

Figure 4:
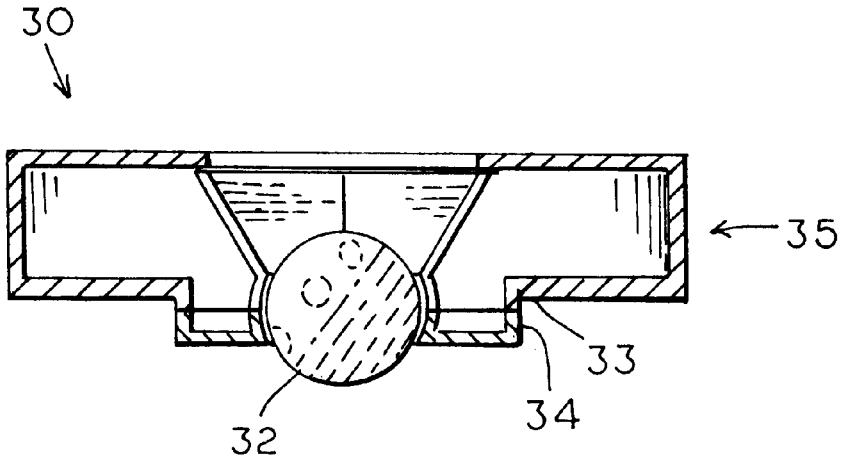
FIG. 4 is a partial cross-sectional view of a toy device in another preferred form of the invention.

With reference next to FIG. 4, there is shown a toy device 30 in another preferred form of the invention. Here, the device 30 is similar to that previously describe except for the design of the sphere 32. Here, the sphere 32 is captured between a top half 33 and a bottom half 34 of the housing 35. The capturing of the sphere 32 allows it to be rotated in any direction relative to the housing 35.

While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A toy device comprising:

a housing having an upper side and a lower side opposite said upper side, a rotatable member mounted to said housing, said rotatable member projecting outwardly from said housing lower side; and an annular array of reflective surfaces positioned upon said housing upper side and concentrically about said rotatable member;

said housing having a size and shape so that said device may be stably positioned upon a substantially horizontal, planar underlying surface with the rotatable member and a portion of the housing contacting the underlying surface and with the annular array of reflective surfaces facing generally upwardly, whereby a child may move the device across the underlying surface to cause the rotation of the rotatable member, with the image of the rotatable member being reflected upwardly by the annular array of reflective surfaces.

2. The toy device of claim 1 wherein said rotatable member is a sphere.

3. The toy device of claim 2 wherein said sphere may be rotated about two axes.

4. The toy device of claim 3 wherein said sphere has an orb having an annular groove therein, a ring sized and shaped to be received within said annular groove to allow rotational movement of said orb relative to said ring in a first direction, and a pivot extending between said ring and said housing to allow rotational movement of said ring relative to said housing in a second direction generally normal to said first direction.

5. The toy device of claim 4 wherein said pivot comprises a pivot pin extending from said ring.

6. The toy device of claim 1 wherein said rotatable member is opaque and wherein light emanating from the upper side of the device is reflecting off said rotatable member and annular array of reflective surface upwardly so as to viewed from a position generally above said device.

7. A toy device comprising:

a housing having a viewable side and another side opposite said viewable side;

a rotatable member mounted to said housing; and an annular array of reflective surfaces mounted to said housing concentrically about said rotatable member at an angle to reflect the image of said rotatable member towards a person facing said viewable side of said device.

8. The toy device of claim 7 wherein said rotatable member extends past said other side of the housing.

9. The toy device of claim 7 wherein said rotatable member is a sphere.

10. The toy device of claim 9 wherein said sphere may be rotated about two axes.

11. The toy device of claim 7 wherein said sphere has an orb having an annular groove therein, a ring sized and shaped to be received within said annular groove to allow rotational movement of said orb relative to said ring in a first direction, and a pivot extending between said ring and said housing to allow rotational movement of said ring relative to said housing in a second direction generally normal to said first direction.

12. The toy device of claim 11 wherein said pivot comprises a pivot pin extending from said ring.

13. The toy device of claim 7 wherein said rotatable member is opaque and wherein light emanating from the upper side of the device is reflecting off said rotatable member and annular array of reflective surface upwardly so as to viewed from a position generally above said device.

14. The toy device of claim 7 wherein said housing has a size and shape so that said device may be stably positioned upon a substantially horizontal, planar underlying surface the rotatable member and a portion of the housing contacts the underlying surface with the annular array of reflective surfaces facing generally upwardly, whereby a child may move the device across the underlying surface to cause the rotation of the rotatable member, with the image of the rotatable member being reflected upwardly by the annular array of reflective surfaces.

15. A toy device comprising:

a housing having a viewable side and another side opposite said viewable side;

a rotatable member mounted to said housing, said rotatable member includes an orb having an annular groove therein, a ring sized and shaped to be received within said annular groove to allow rotational movement of said orb relative to said ring in a first direction, and a pivot coupled to said ring and said housing to allow rotational movement of said ring relative to said housing in a second direction generally normal to said first direction; and an annular array of reflective surfaces mounted to said housing concentrically about said rotatable member at an angle to reflect the image of said rotatable member towards a person facing said viewable side of said device.

16. The toy device of claim 15 wherein said pivot comprises a pivot pin extending from said ring.

17. The toy device of claim 15 wherein said rotatable member is opaque and wherein light emanating from the viewable side of the device is reflecting off said rotatable member and annular array of reflective surface upwardly so as to viewed from a position facing said viewable side.

18. The toy device of claim 15 wherein said rotatable member extends past said other side of the housing.

* * * * *